US006220443B1

(12) United States Patent
Damaskos

(10) Patent No.: US 6,220,443 B1
(45) Date of Patent: Apr. 24, 2001

(54) PACKAGE

(76) Inventor: Steve Damaskos, 78 Metropolitan Ave., Boston, MA (US) 02131

( * ) Notice: Subject to any disclaimer, the term of this patent is extended or adjusted under 35 U.S.C. 154(b) by 0 days.

(21) Appl. No.: 09/296,354

(22) Filed: Apr. 22, 1999

(51) Int. Cl.[7] ..... B65D 5/44
(52) U.S. Cl. ..... 206/763; 206/315.9; 206/485
(58) Field of Search ..... 206/744–750, 206/763, 315.9, 418, 588, 485; 229/116.1

(56) References Cited

U.S. PATENT DOCUMENTS

| | | | | |
|---|---|---|---|---|
| D. 141,077 | | 5/1945 | Sawyer . | |
| 611,063 | | 9/1898 | Davis . | |
| 1,171,083 | | 2/1916 | Bailey . | |
| 1,210,008 | | 12/1916 | Singer et al. . | |
| 2,019,414 | | 10/1935 | Isacson . | |
| 2,126,407 | * | 8/1938 | Payne et al. | 206/747 |
| 2,296,389 | * | 9/1942 | Levkoff | 206/748 |
| 2,324,436 | | 7/1943 | Snyder . | |
| 2,706,037 | | 4/1955 | Feigelman . | |
| 2,980,244 | * | 4/1961 | Gendre | 206/418 |
| 3,123,204 | * | 3/1964 | Baker et al. | 206/315.91 |
| 3,357,543 | | 12/1967 | Taggart . | |
| 4,462,178 | | 7/1984 | Freeman . | |
| 4,779,726 | | 10/1988 | Pratt . | |
| 5,322,210 | | 6/1994 | Chila et al. . | |

* cited by examiner

*Primary Examiner*—Jim Foster
(74) *Attorney, Agent, or Firm*—Ostrolenk, Faber, Gerb & Soffen, LLP

(57) ABSTRACT

A package that is manipulable between an encapsulating position, for shipping or storing, and a displaying position, for exposing and retaining, an object. An embodiment configured according to principles of the invention includes a main compartment with a main aperture for retaining an object. The package has one or more manipulable adjacent compartments, each with an adjacent aperture, which maintain the object in the adjacent aperture when the package is in the closed position.

11 Claims, 16 Drawing Sheets

Fig. 7
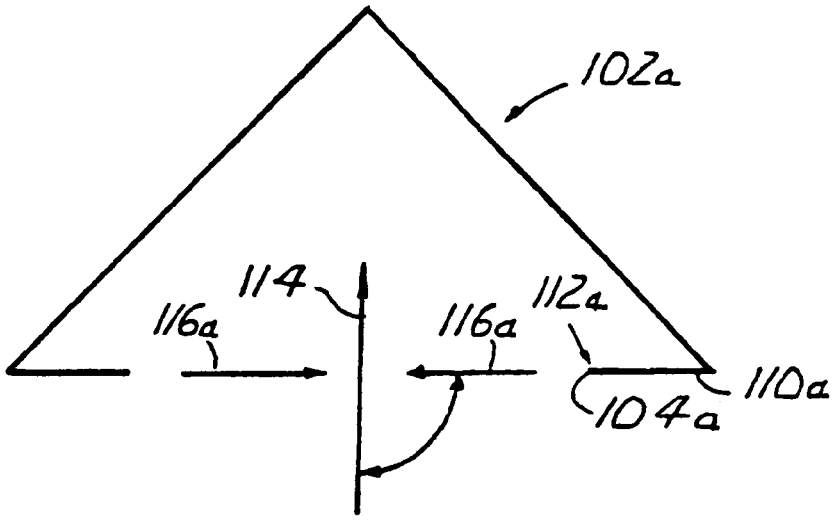
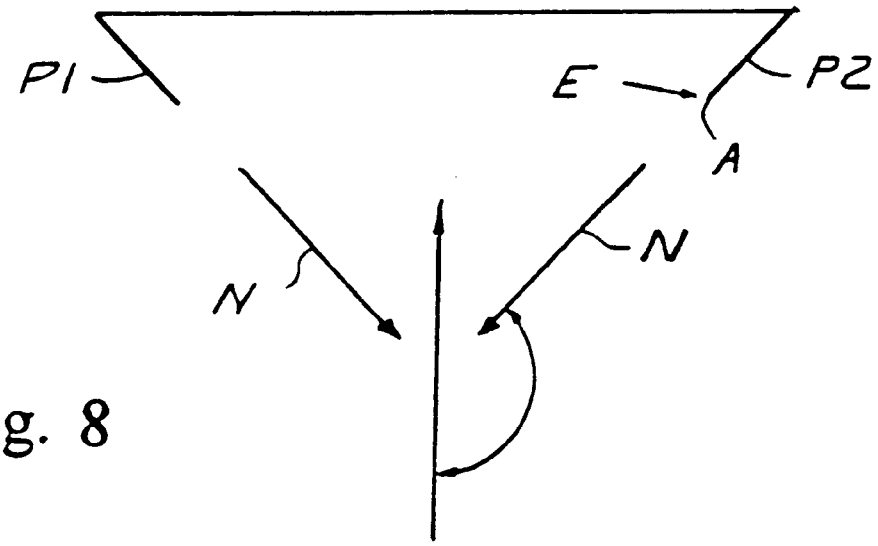
Fig. 8

Fig. 21
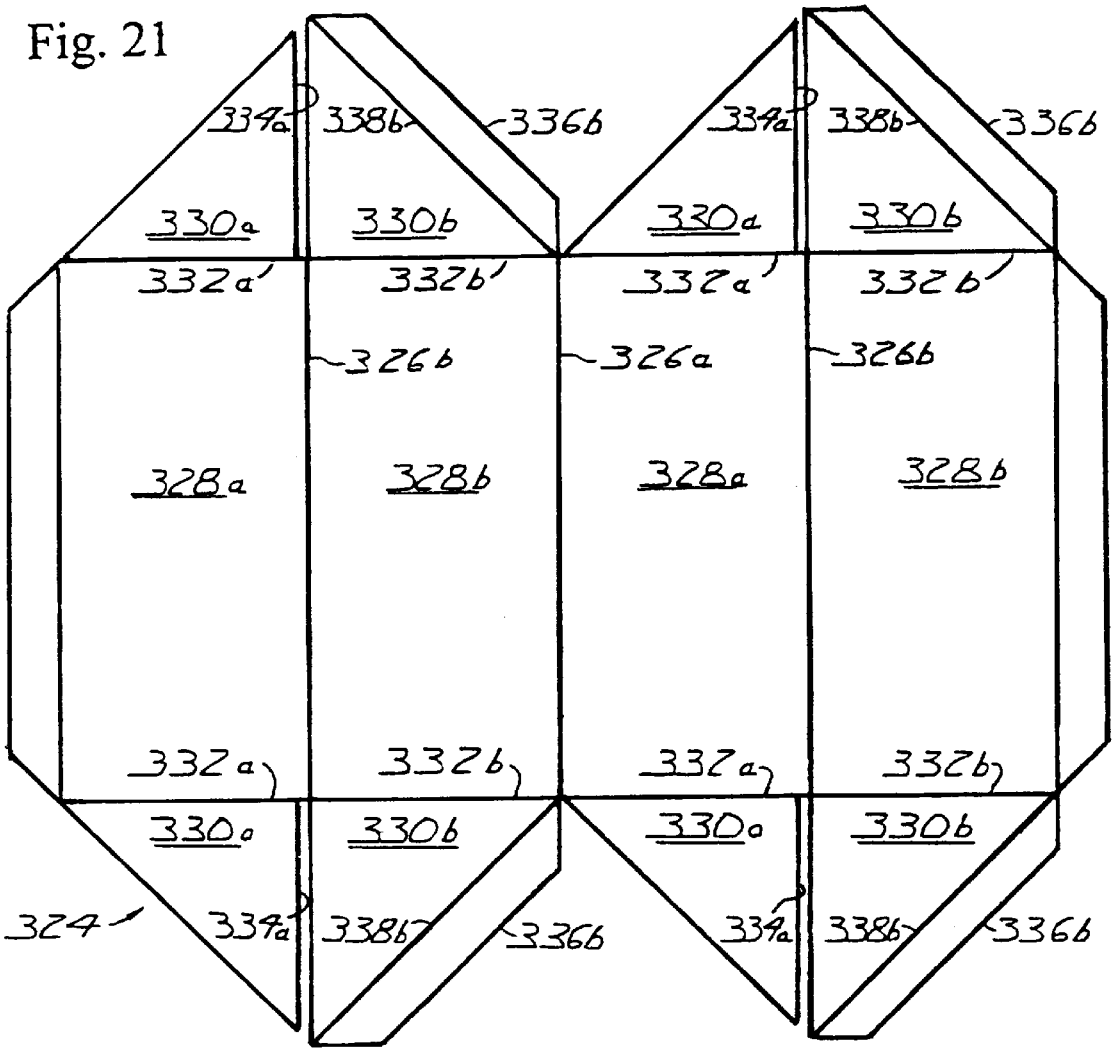
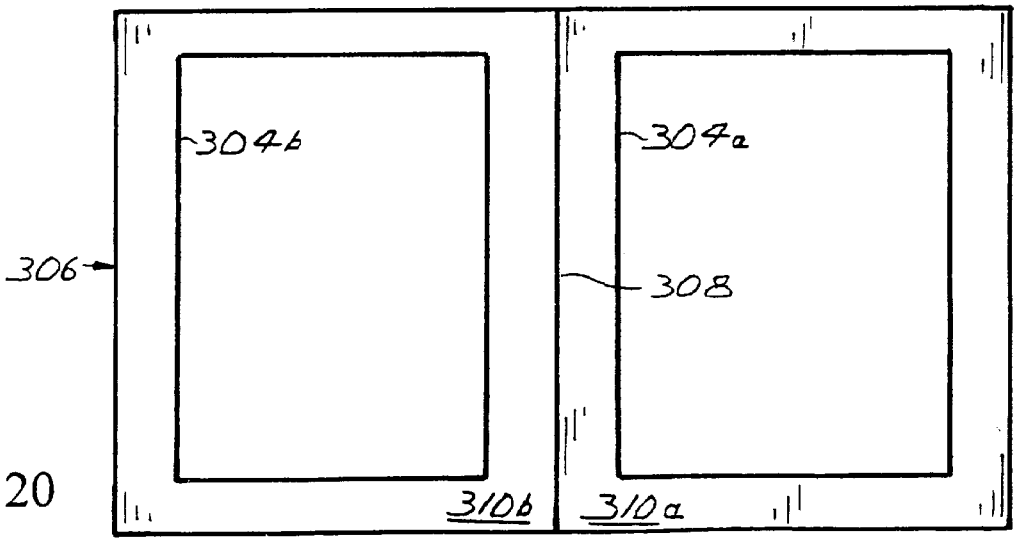
Fig. 20

PACKAGE

BACKGROUND OF THE INVENTION

1. Field of the Invention

The invention relates to packaging for shipping and displaying objects.

2. Discussion of Related Art

Product packaging has evolved from being merely a shipping aid into a crucial marketing tool. More than ever, package design is directed to enhancing product attractiveness. Many different package designs have been developed which provide for both protecting products during shipping and displaying the products in a marketplace once shipped. Some designs provide perforations or other conventions for severing a package wall or walls so that portions of the package may be folded away to expose the contents of the package. See, for example, U.S. Pat. No. Des. 141,077, issued May 1, 1945, to J. P. Sawyer, entitled Display Box; U.S. Pat. No. 2,324,436, issued Jul. 13, 1943, to D. J. Snyder, entitled Packing And Display Case; and U.S. Pat. No. 2,706,037, issued Apr. 12, 1955, to H. A. Feigelman, entitled Folding Shipping And Display Boxes.

Other designs provide a manipulable package including one or more panels, each having an aperture for viewing the package contents. See, for example, U.S. Pat. No. 611,063, issued Sep. 20, 1898, to C. E. Davis, entitled Counter Display Box; U.S. Pat. No. 1,210,008, issued Dec. 26, 1916, to J. B. Singer et al., entitled Display Device; U.S. Pat. No. 3,357,543, issued Dec. 12, 1967, to R. B. Taggart, entitled Display And Gift Box; and U.S. Pat. No. 4,462,178, issued Jul. 31, 1984, to S. D. Freeman, entitled Display Structure Formed Of A Unitary Blank.

Some designs provide an internal panel, or combination of panels essentially functioning as a singular panel, having apertures, each for receiving, but not retaining, an object. See, for example, U.S. Pat. No. 1,171,083, issued Feb. 8, 1916, to B. F. Bailey, entitled Egg Box; and U.S. Pat. No. 2,019,414, issued Oct. 29, 1935, to O. L. Isacson, entitled Box For Packing Eggs And Similar Fragile Objects.

Other designs provide for retaining an object with cooperating slotted internal panels and exposing the contents to some extent. However, complete access to the contents requires destruction of the package. See, for example, U.S. Pat. No. 4,779,726, issued Oct. 25, 1988, to M. S. Pratt, entitled Packaging.

Still other designs provide for a package composed of hinged prism-like compartments which may be manipulated to register apertures in each compartment and receive objects. However, the apertures do not positively retain the object. See, for example, U.S. Pat. No. 5,322,210, issued Jun. 21, 1994, to J. P. Chila et al., entitled Display Box.

Unfortunately, none of the foregoing provides a package that is manipulable between an encapsulating position, for shipping or storing, and a displaying position, for exposing and retaining, an object. None of the aforementioned references, taken alone or in combination, are seen as teaching or suggesting the presently claimed Package.

SUMMARY OF THE INVENTION

The invention is a package that is manipulable between an encapsulating position, for shipping or storing, and a displaying position, for exposing and retaining, an object. The invention provides a package for storing, shipping, protecting, retaining, displaying and promoting an object. The invention provides improved elements and arrangements thereof, in an apparatus for the purposes described which are inexpensive, dependable and effective in accomplishing its intended purposes.

An embodiment configured according to principles of the invention includes a main compartment with a main aperture for retaining an object. The package has one or more manipulable adjacent compartments, each with an adjacent aperture, which accommodate the object. The adjacent compartments may maintain the object in the adjacent aperture when the package is in the closed position.

These and other features of the invention will be appreciated more readily in view of the drawings and detailed description below.

BRIEF DESCRIPTION OF THE DRAWINGS

The invention is described in detail below with reference to the following drawings, throughout which similar reference characters denote corresponding features consistently, wherein:

FIG. 7 is a partial cross-sectional detail view of the main compartment of the embodiment of FIG. 1, drawn along line VII—VII in FIG. 1;

FIG. 8 is a horizontal, cross-sectional detail view of a compartment having a non-planar interior panel;

FIG. 20 is a plan view of a blank for an inner panel of the embodiment of FIG. 18;

FIG. 21 is a plan view of a blank for an outer panel of the embodiment of FIG. 18;

DETAILED DESCRIPTION OF THE INVENTION

The invention provides a convertible package for concealing and exposing a retained object. The package is manipulable between an encapsulating position, for shipping or storing, and a displaying position, for exposing, a retained object.

Figure 1:
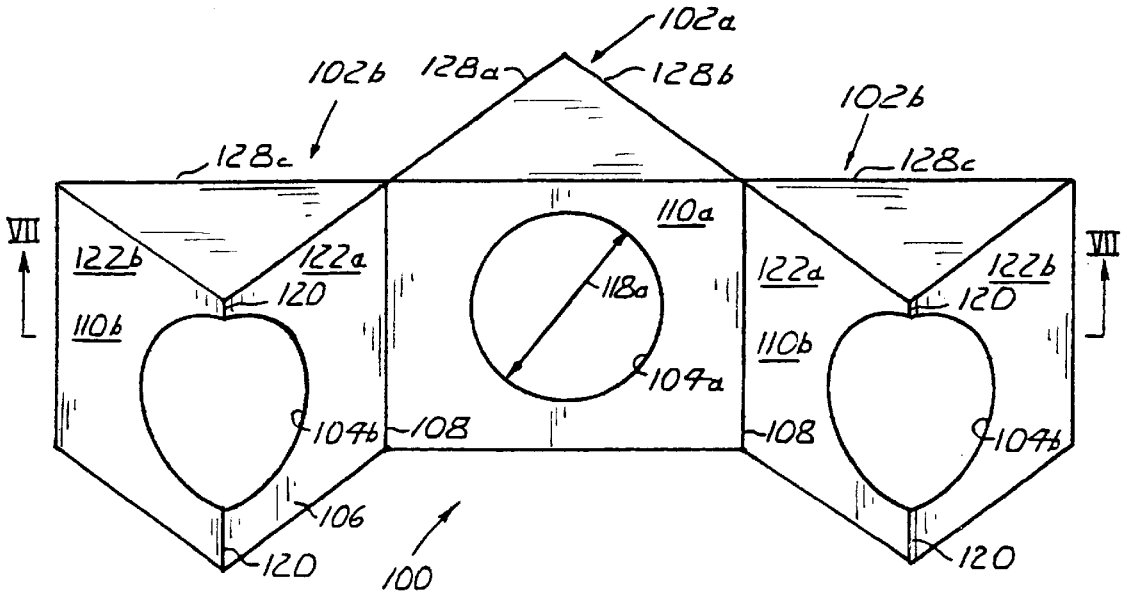
FIG. 1 is a top right front elevational view of an embodiment of a package, manipulated into an open position, constructed according to principles of the invention.
Figure 2:
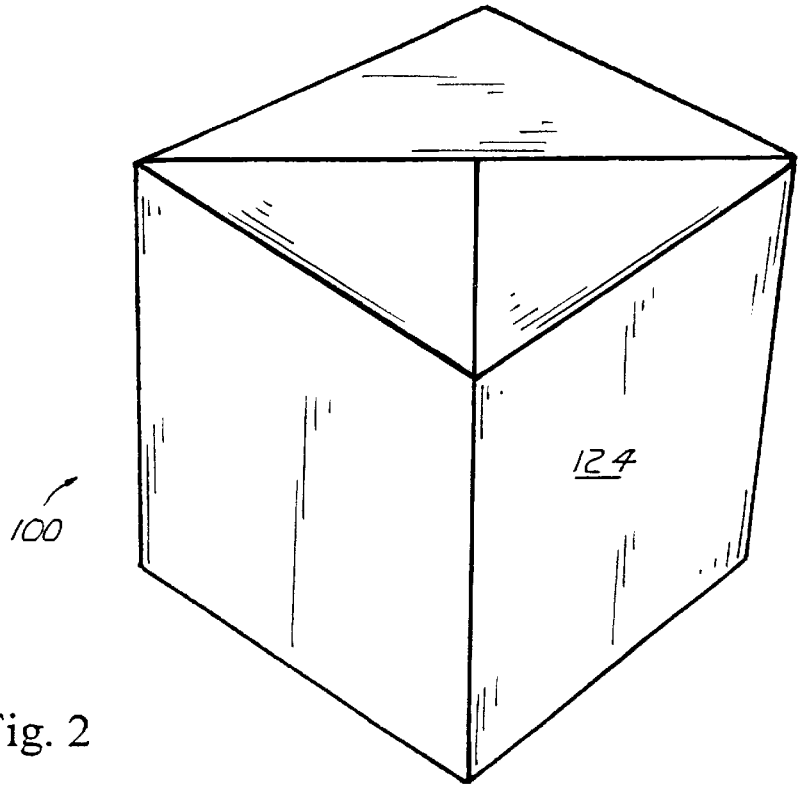
FIG. 2 is a top right front elevational view of the embodiment of FIG. 1, manipulated into a closed position.

Referring to FIG. 1, one embodiment of a package 100 configured according to principles of the invention is shown manipulated into an open position. FIG. 2 shows the package 100 manipulated into a closed position. The package 100 has a main compartment 102*a* with a main aperture 104*a* for retaining an object (not shown). The package 100 has manipulable adjacent compartments 102*b* each with an adjacent aperture 104*b* which accommodate the object (not shown). The adjacent compartments 102*b* may maintain the object (not shown) in the adjacent apertures 104*b* when the package 100 is in the closed position. However, the apertures 104*b* do not retain or seize the object (not shown) or otherwise discourage dislodgement from the adjacent compartment 102*b*.

Figure 3:
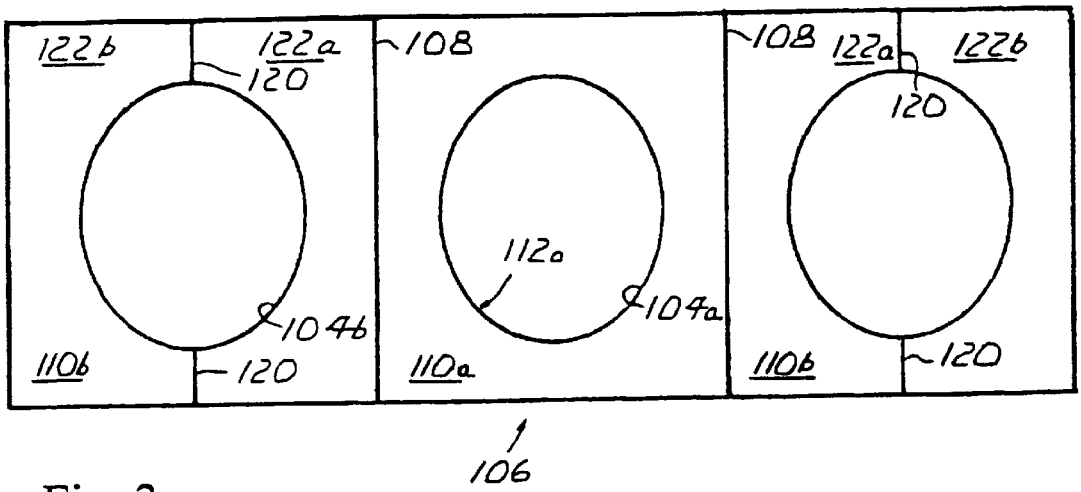
FIG. 3 is a plan view of a blank for an inner panel of the embodiment of FIG. 1.
Figure 5:
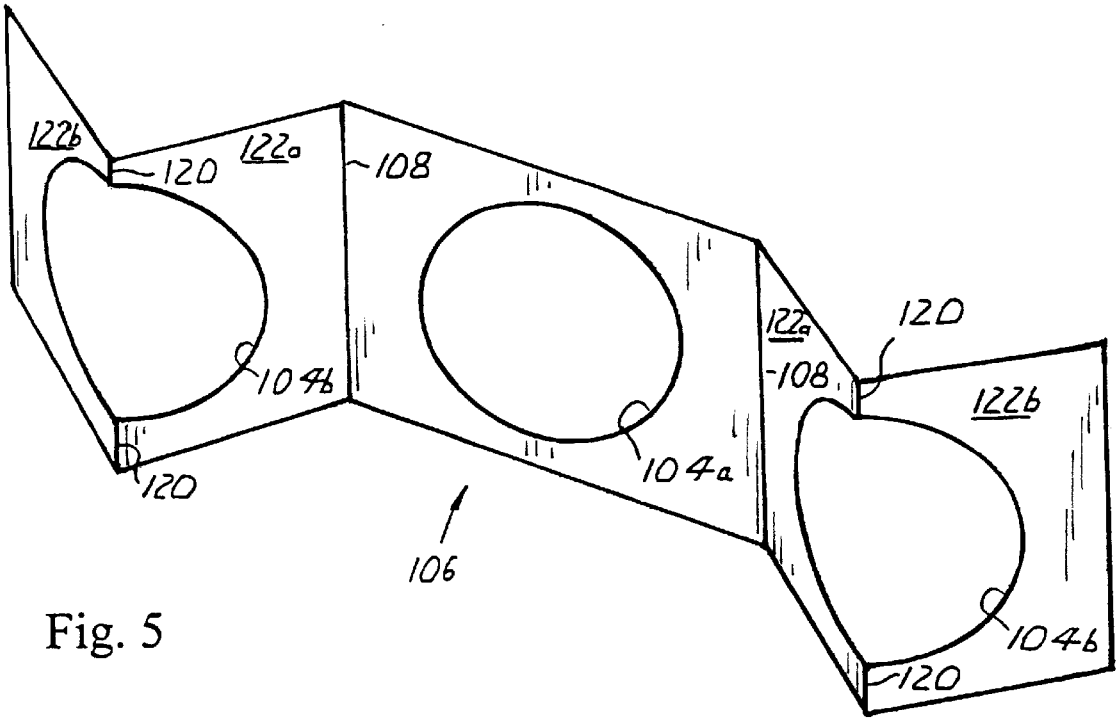
FIG. 5 is a top right front elevational view of the embodiment of FIG. 3, in a folded configuration prior to assembly with the embodiment of FIG. 6.

Referring also to FIGS. 3 and 5, the package 100 includes an inner blank 106 that is folded along fold lines 108, defining a plurality of interior panels 110*a* and 110*b*. The main interior panel 110*a* provides the main aperture 104*a* and the adjacent interior panels 110*b* provide the adjacent apertures 104*b*.

In this embodiment, as shown on FIGS. 1, 5 and 7, the main interior panel 110*a* essentially defines a plane, thus the main aperture 104*a* falls essentially within a plane. Although the invention does not require that the main interior panel 110*a* or main aperture 104*a* remain in a plane, the main aperture 104*a* is configured to retain an object. Retaining an object is achieved best with, but not limited to, a planar main interior panel with an aperture for receiving and retaining the object.

Retaining an object includes restricting the ability of the object to become dislodged from the compartment 102*a*. Preventing dislodgement is achieved, for example, by squeezing the object. Referring to FIG. 7, when the main aperture 104*a* remains in one plane, the annular inner edge 112*a* of the main aperture 104*a* contacts or "bites" into the side of an appropriately sized object inserted therein, generally orthogonally with respect to the insertion direction 114. The contact forces 116*a* which squeeze an object or resist its passage through the main aperture 104*a* substantially have a common locus also within the plane of the main interior panel. This convention promotes stable maintenance of an object once inserted because the contact forces 116*a* are balanced, falling substantially within the plane of the main interior panel, thus have marginal orthogonal force components which would urge the object from the main aperture 104*a*. For example, when the package is intended to retain an object, such as a ball, the main aperture 104*a* may be configured with a diameter 118*a* that is equal to or less than the diameter of the ball. In the case of a baseball, which generally is symmetrical about any axis, the aperture 104*a* may be configured with a circular shape having an annular edge that bites into the soft surface of the ball.

Referring to FIG. 8, where an aperture A occurs over multiple planes P1 and P2, the inner edge E of the aperture A contacts the side of an inserted object with normal forces N that are not balanced, but have significant orthogonal force components that would urge the object from the main aperture A.

Referring again to FIG. 1, the package 100 also may restrict object dislodgment therefrom by providing a passage that discourages passage of the object. For example, the aperture 104*a* may be configured with a circular shape having a diameter that is slightly smaller than the diameter of the ball so that, once slightly more than half of the ball is forced through the aperture, the relatively smaller aperture will resist passage of the ball back through. To this end, the main interior panel 110*a* may be constructed from material that deforms sufficiently to allow forceful introduction of the ball through the main aperture 104*a* and regains a sufficient amount of its relatively smaller pre-insertion configuration.

Figure 10:
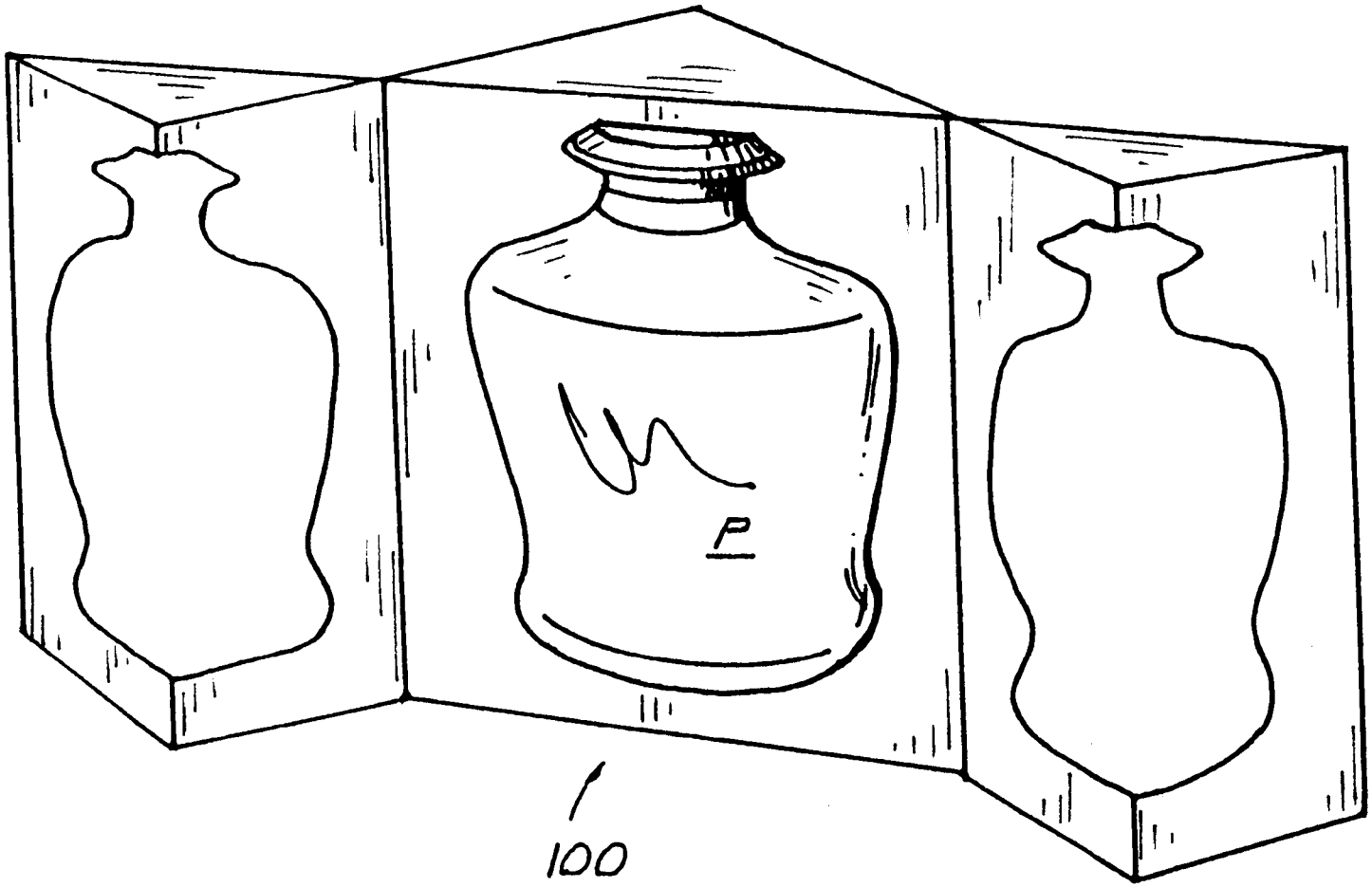
FIG. 10 is a top right front elevational view of the embodiment of FIG. 1, retaining a second object.

For irregularly-shaped objects, such as a bottle, the main aperture 104*a* may correspond to an outer surface of the bottle, as shown in the embodiment of FIG. 10, for example. The edge 112*a* of the aperture 104*a* need not entirely contact an inserted object, only a sufficient amount of the object that the aperture 104*a* can grip, overlap or otherwise resist object dislodgement.

Referring again to FIGS. 1, 3 and 5, the adjacent interior panels 110*b* are folded along fold lines 120, respectively, defining sub-panels 122*a* and 122*b*. Thus, adjacent apertures 104*b* occur on diverse planes defined by the sub-panels 122*a* and 122*b*. The adjacent apertures 104*b* are configured to contact or maintain an object when the package 100 is in the closed position, as shown in FIG. 2. To this end, the adjacent apertures 104*b* may be sized to complement or be oversized with respect to the surface of the object which the adjacent apertures 104*b* contact. Maintaining an object means that the object substantially is prevented from moving. Maintaining does not mean that the object is positively retained, squeezed or otherwise engaged by the aperture 104*b*. In maintaining an object, the adjacent interior panels 110*b* and adjacent apertures 104*b* function like pedestals under free-standing objects.

Figure 4:
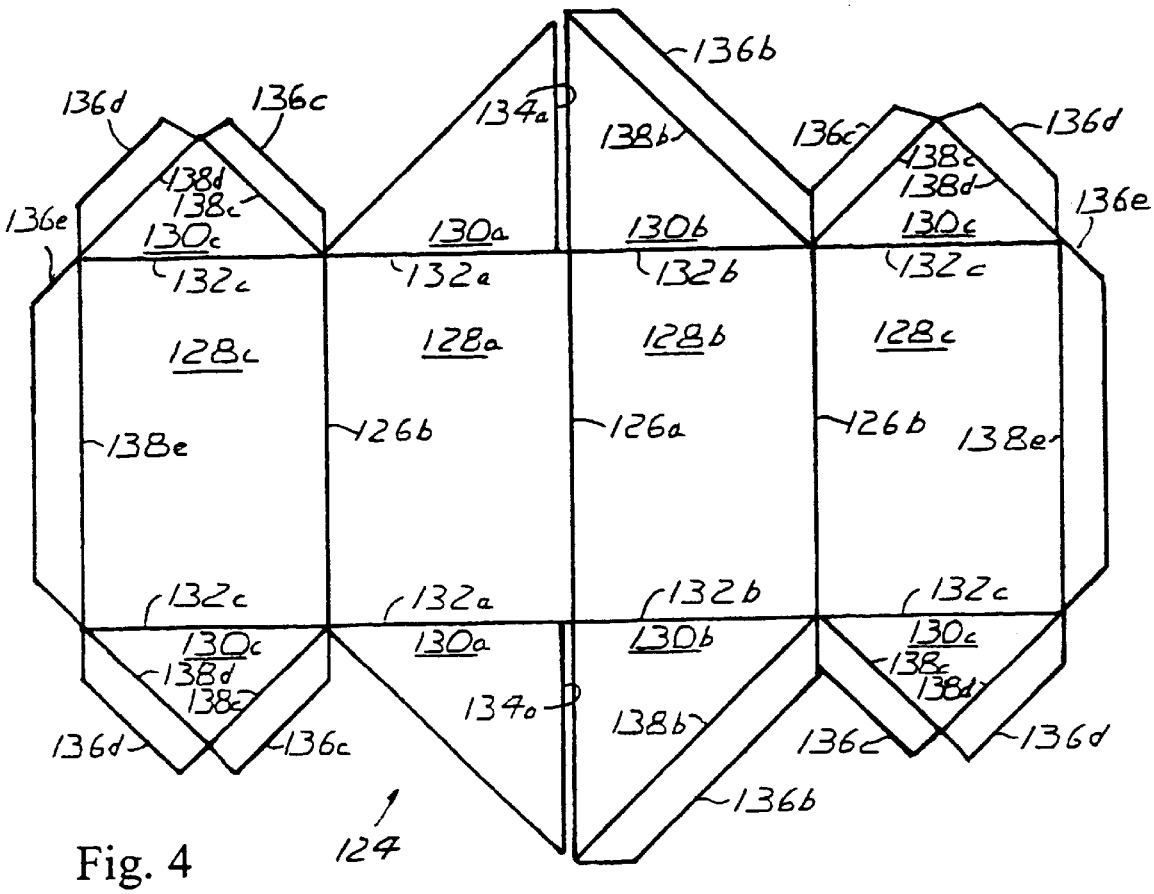
FIG. 4 is a plan view of a blank for an outer panel of the embodiment of FIG. 1.
Figure 6:
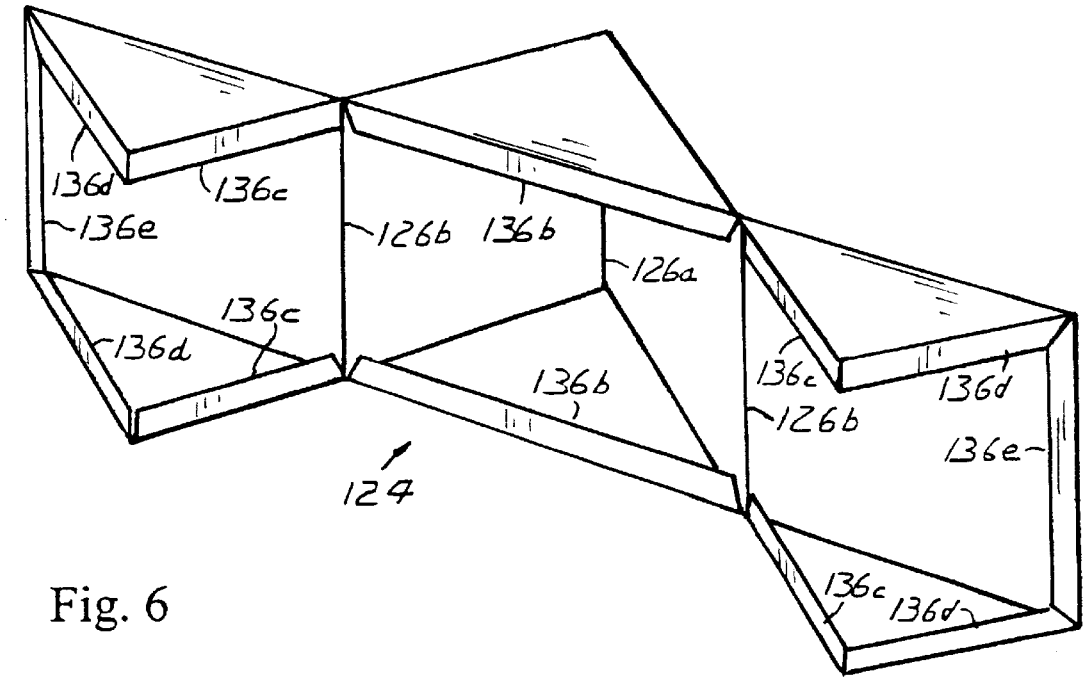
FIG. 6 is a top right front elevational view of the embodiment of FIG. 4, in a folded configuration prior to assembly with the embodiment of FIG. 5.

Referring to FIGS. 1, 4 and 6, the package 100 includes an exterior blank 124 that is folded along fold lines 126*a* and 126*b*, defining a plurality of panels 128*a–c*. As shown in FIG. 1, the main exterior panels 128*a–b* and main interior panel 110*a* define the main compartment 102*a*. Each adjacent exterior panel 128*c* and set of sub-panels 122*a* and 122*b* define an adjacent compartment 102*b*.

Referring to FIGS. 4 and 6, the exterior blank 124 mounts onto the interior blank 106 with glued tabs configured to maintain the interior blank 106 in the intended design positions, as shown in FIGS. 1, 2 and 5. To that end, the main exterior panel 128*a* of the exterior blank 124 includes flaps 130*a* that fold along fold lines 132*a* toward the viewer until each flap 130*a* defines essentially a right dihedral angle with the main exterior panel 128*a*. The main exterior panel 128*a* is folded along fold line 126*a* toward the viewer until the lateral edges 134*a* abut the main exterior panel 128*b*. Abutment of the lateral edges 134*a* and main exterior panel 128*b* is not critical to the design, but aids in assembly of the package 100. Offsetting the lateral edges 134*a* from the fold line 126*a* also is not critical, but aids in assembly of the package 100.

The main exterior panel 128*b* includes flaps 130*b* with tabs 136*b*. Once the main exterior panels 128*a* and *b* and flaps 130*a* are positioned, the flaps 130*b* are folded along fold lines 132*b* toward the viewer until each flap 130*b* contacts a flap 130*a* and defines essentially a right dihedral angle with the main exterior panel 128*b*. Contact between the flaps 130*a* and *b* is not critical to the invention, but such enhances package integrity. Once the flaps 130*b* are positioned, tabs 136*b* are folded along fold lines 138*b* toward each other and positioned to mate with main interior panel 110*a*, as shown in FIG. 6.

The adjacent exterior panels 128*c* each include flaps 130*c* with tabs 136*c* and *d*. The flaps 130*c* are folded along fold lines 132*c* toward the viewer until each flap 130*c* defines essentially a right dihedral angle with its associated adjacent exterior panel 128*c*. Once the flaps 130*c* are positioned, tabs 136*c* are folded along fold lines 138*c* toward each other and positioned to mate with a sub-panel 122*a*, as shown in FIG. 6. Tabs 136*d* are folded along fold lines 138*d* toward each other and positioned to mate with a sub-panel 122*b*, as shown in FIG. 6.

The outermost adjacent exterior panels 128*c* also include tabs 136*e* which are folded along fold lines 138*e* toward the viewer and positioned to mate with a sub-panel 122*b*, as shown in FIG. 6.

Figure 9:
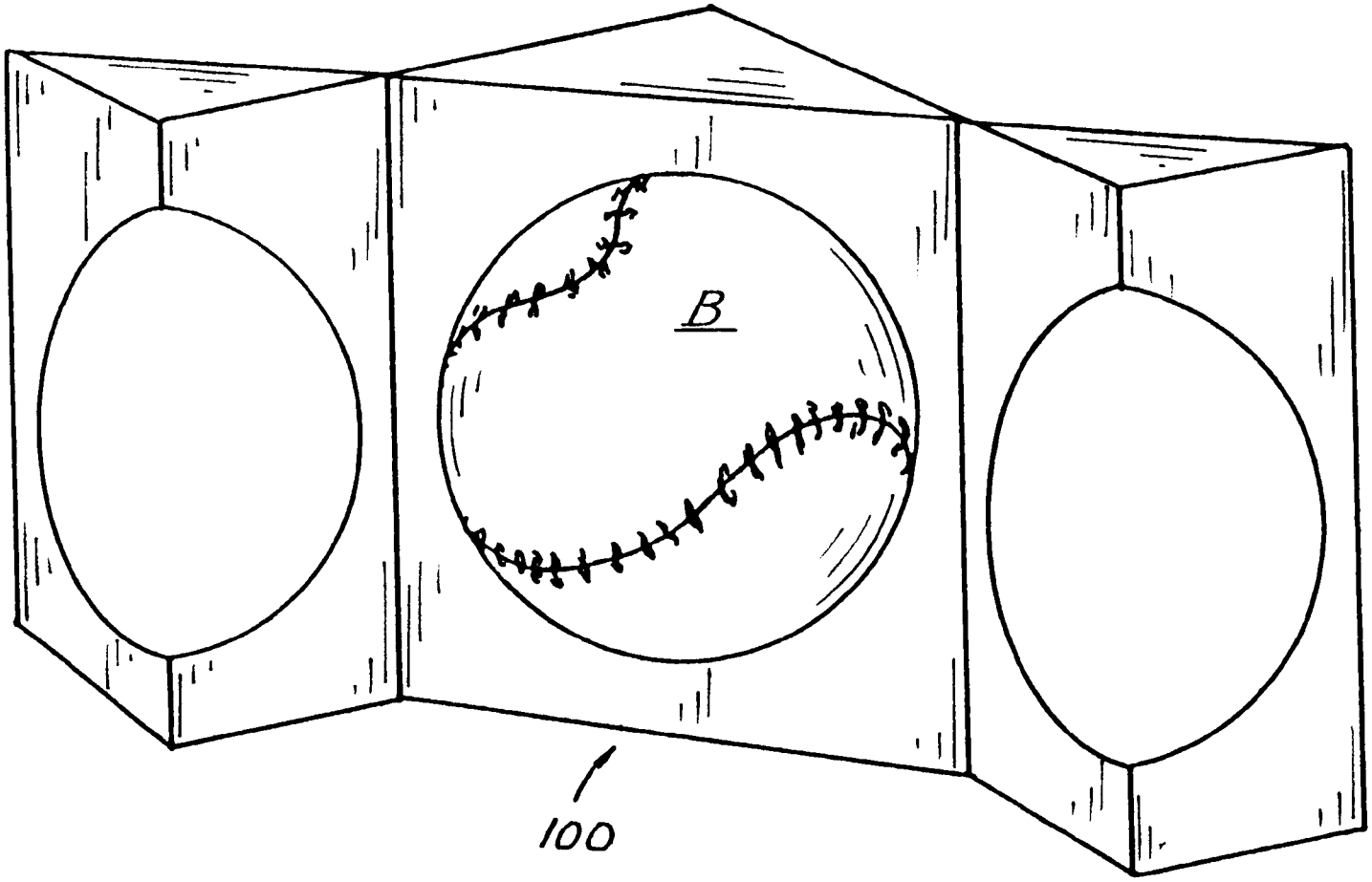
FIG. 9 is a top right front elevational view of the embodiment of FIG. 1, retaining a first object.

All embodiments of the invention are adaptable for protecting various objects during shipment and for retaining and displaying them. For example, FIG. 9 shows the package 100 retaining and displaying a baseball B. FIG. 10 shows the package 100 retaining and displaying a perfume bottle P.

Figure 12:
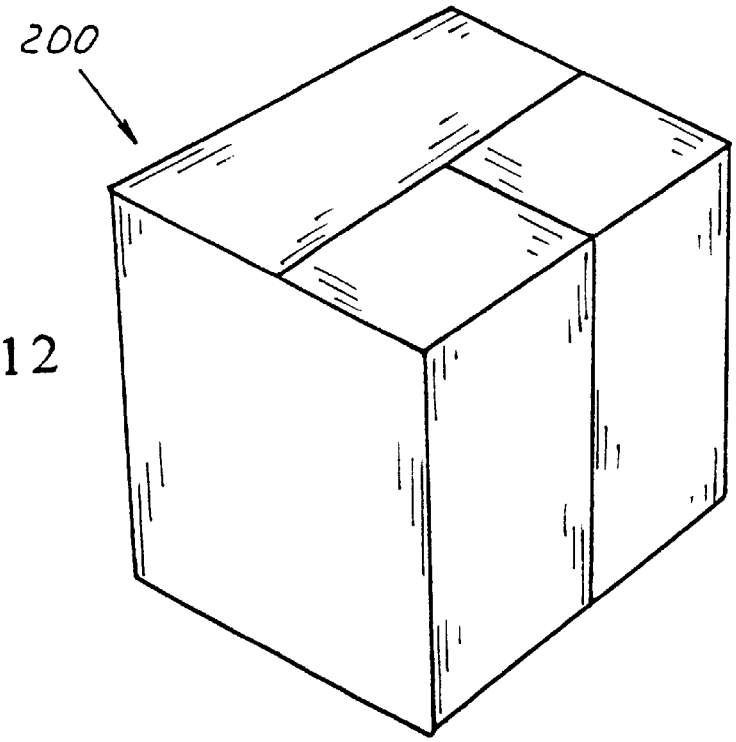
FIG. 12 is a top right front elevational view of the embodiment of FIG. 11, manipulated into a closed position.
Figure 11:
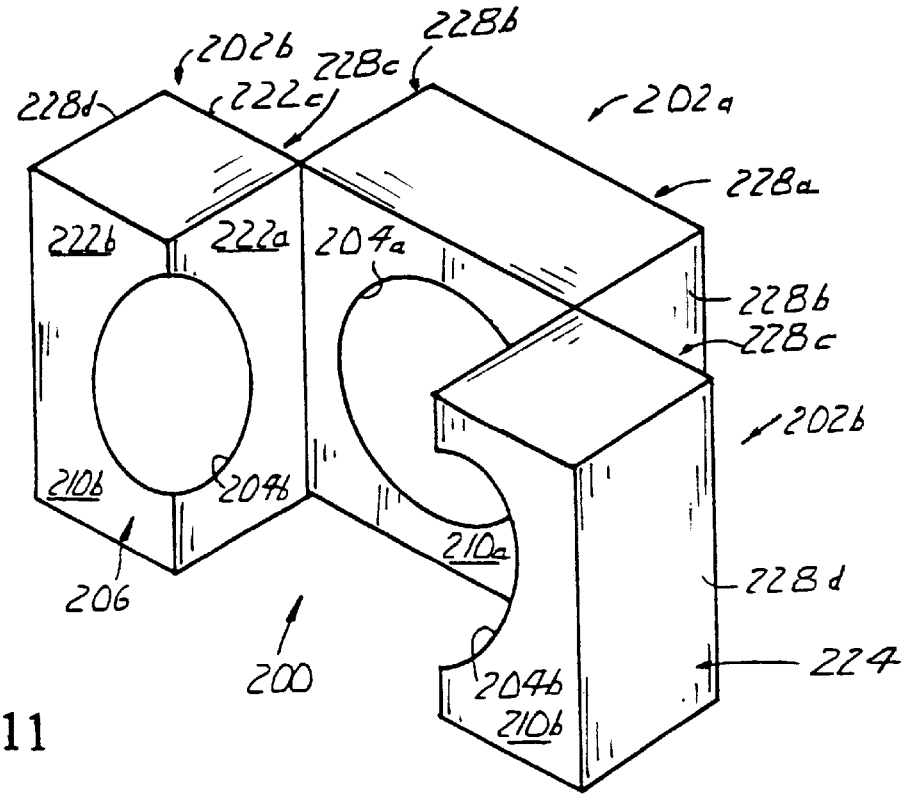
FIG. 11 is a top right front elevational view of another embodiment of a package, manipulated into an open position, constructed according to principles of the invention.

Referring to FIG. 11, another embodiment of a package 200 configured according to principles of the invention is shown manipulated into an open position. FIG. 12 shows the package 200 manipulated into a closed position. The package 200 has a main compartment 202*a* with a main aperture 204*a* for retaining an object (not shown). The package 200 has manipulable adjacent compartments 202*b* each with an adjacent aperture 204*b* which accommodate the object (not shown). The adjacent compartments 202*b* may maintain the object (not shown) in the adjacent aperture 204*a* when the package 200 is in the closed position.

Figure 13:
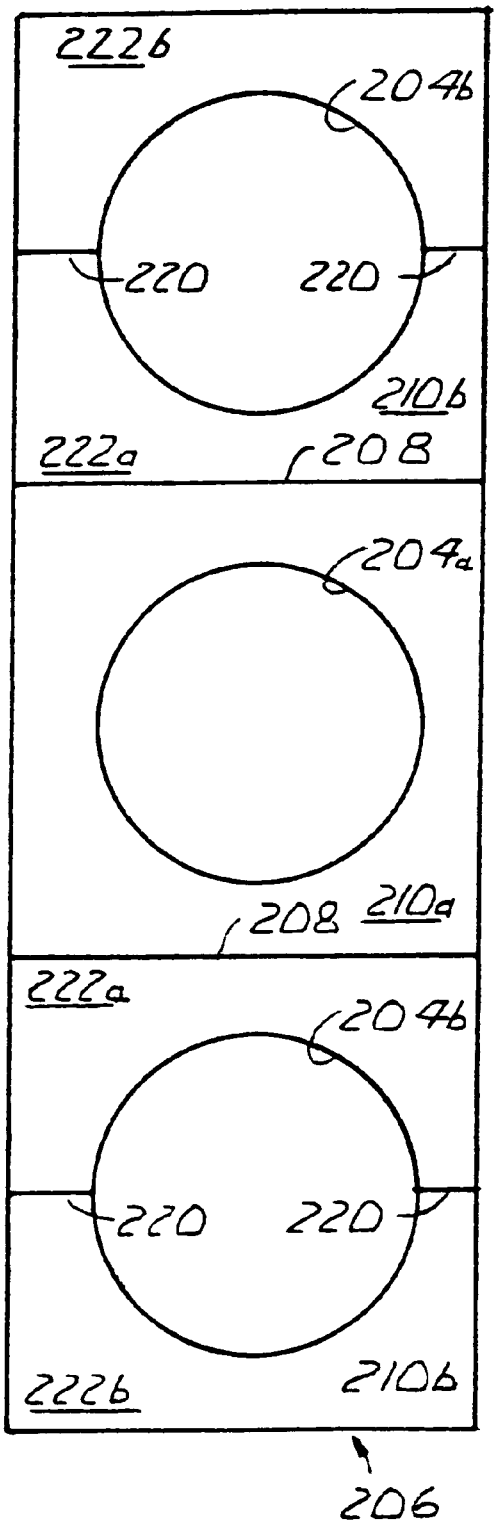
FIG. 13 is a plan view of a blank for an inner panel of the embodiment of FIG. 11.

Referring also to FIG. 13, the package 200 includes an inner blank 206 that is folded along fold lines 208, defining a plurality of interior panels 210*a* and 210*b*. The main interior panel 210*a* provides the main aperture 204*a* and the adjacent interior panels 210*b* provide the adjacent apertures 204*b*. In this embodiment, as shown on FIG. 11, the main interior panel 210*a* essentially defines a plane, thus the main aperture 204*a* falls essentially within a plane. As with the foregoing embodiment of the package 100, this embodiment of a package 200 does not require that the main interior panel 210*a* or main aperture 204*a* remain in a plane, only that the main aperture 204*a* be configured to retain an object. Also, the principles pertaining to retaining an object with the main compartment 202*a* of the package 200 are substantially similar to the principles discussed for the foregoing embodiment.

The adjacent interior panels 210*b* are folded along fold lines 220, respectively, defining sub-panels 222*a* and 222*b*. Thus, adjacent apertures 204*b* occur on diverse planes defined by the sub-panels 222*a* and 222*b*. As with the foregoing embodiment, the adjacent apertures 204*b* are configured to contact or maintain an object when the package 100 is in the closed position, as shown in FIG. 12. Also, the principles pertaining to maintaining an object with the adjacent compartments 202*b* of the package 200 are substantially similar to the principles discussed for the foregoing embodiment.

Figure 14:
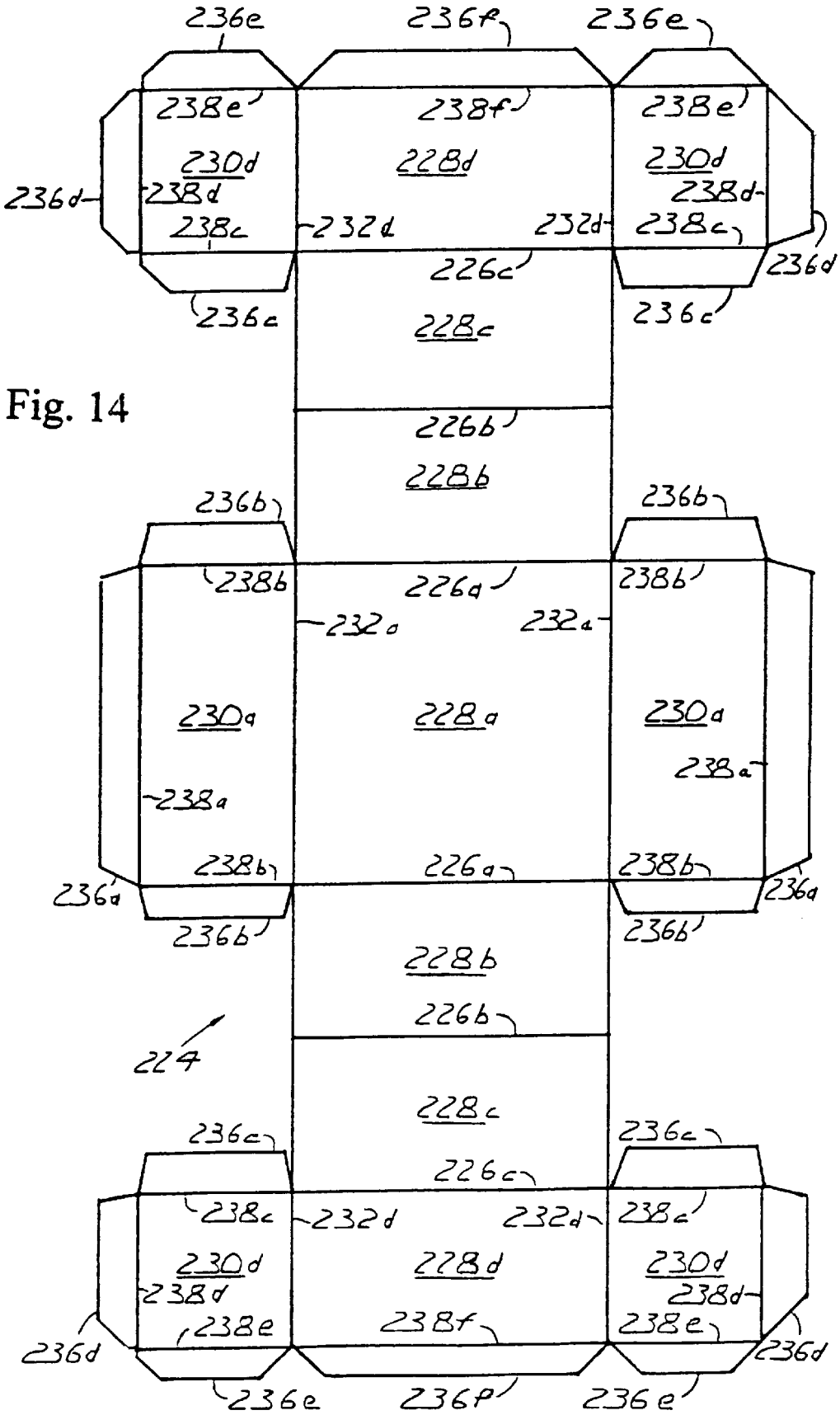
FIG. 14 is a plan view of a blank for an outer panel of the embodiment of FIG. 11.

Referring to FIGS. 11 and 14, the package 200 includes an exterior blank 224 that is folded along fold lines 226*a–c*, defining a plurality of panels 228*a–d*. As shown in FIG. 11, the main exterior panels 228*a–b* and main interior panel 210*a* define the main compartment 202*a*. Each set of adjacent exterior panels 128*c–d* and corresponding set of sub-panels 222*a* and 222*b* define an adjacent compartment 202*b*.

The exterior blank 224 mounts onto the interior blank 206 with glued tabs configured to maintain the interior blank 206 in the intended design positions. To that end, the main exterior panel 228*a* of the exterior blank 224 includes flaps 230*a* that fold along fold lines 232*a* toward the viewer until each flap 230*a* defines essentially a right dihedral angle with the main exterior panel 228*a*. Each flap 230*a* has tabs 236*a* and *b* extending therefrom. Once the flaps 230*a* are positioned, the tabs 236*a* are folded along fold lines 238*a* toward each other and positioned to mate with main interior panel 210*a*. Tabs 236*b* are folded along fold lines 238*b* toward each other and positioned to mate with adjacent exterior panels 228*b*. The adjacent exterior panels 228*b* are folded along fold lines 232*b* until in contact with the tabs 236*b*.

Each adjacent exterior panel 228*d* of the exterior blank 224 includes flaps 230*d* that fold along fold lines 232*d* toward the viewer until each flap 230*d* defines essentially a right dihedral angle with the adjacent exterior panel 228*d*. Each flap 230*d* has tabs 236*c–e* extending therefrom. Once the flaps 230*d* are positioned, the tabs 236*d* are folded along fold lines 238*d* toward each other and positioned to mate with sub-panel 222*a*. Each set of tabs 236*c* and *e* on each flap 230*d* are folded along fold lines 238*c* and *e*, respectively, toward each other. Tabs 236*c* are positioned to mate with adjacent exterior panel 228*c*. Tabs 236*e* are positioned to mate with sub-panel 222*b*. Tabs 236*f* are folded along fold lines 238*f* and also positioned to mate with sub-panel 222*b*.

Figure 15:
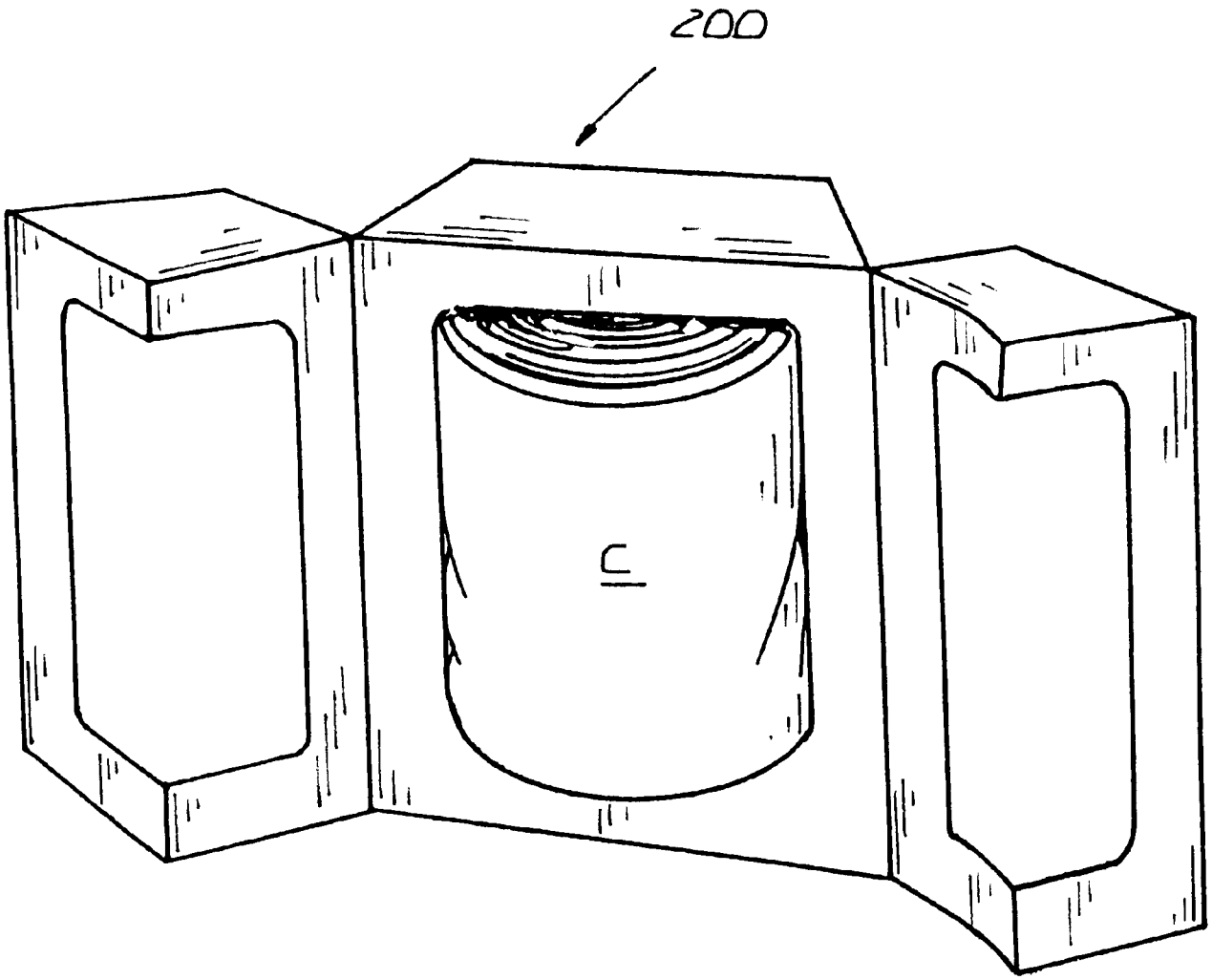
FIG. 15 is a top right front elevational view of the embodiment of FIG. 11, retaining a first object.
Figure 16:
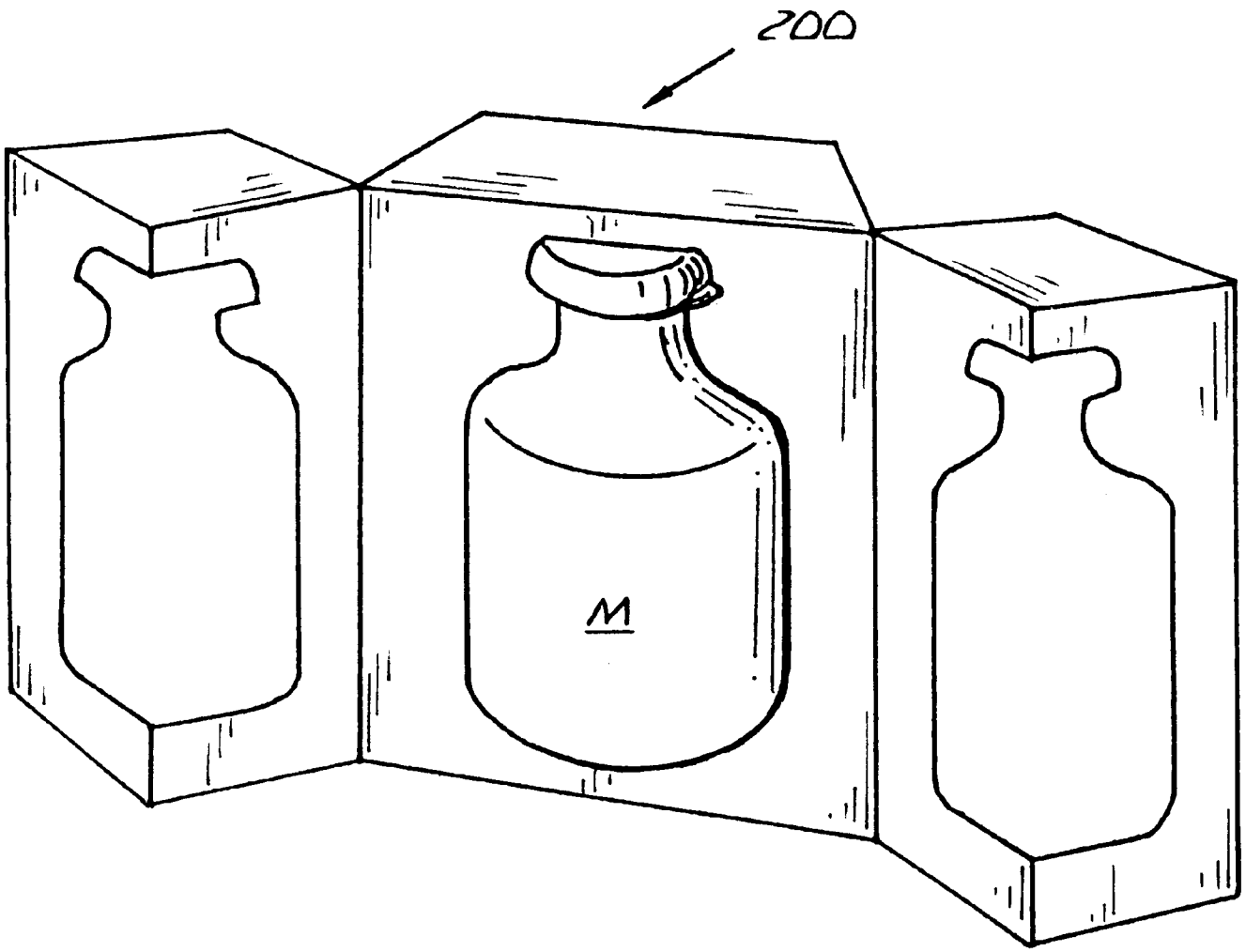
FIG. 16 is a top right front elevational view of the embodiment of FIG. 11, retaining a second object.
Figure 17:
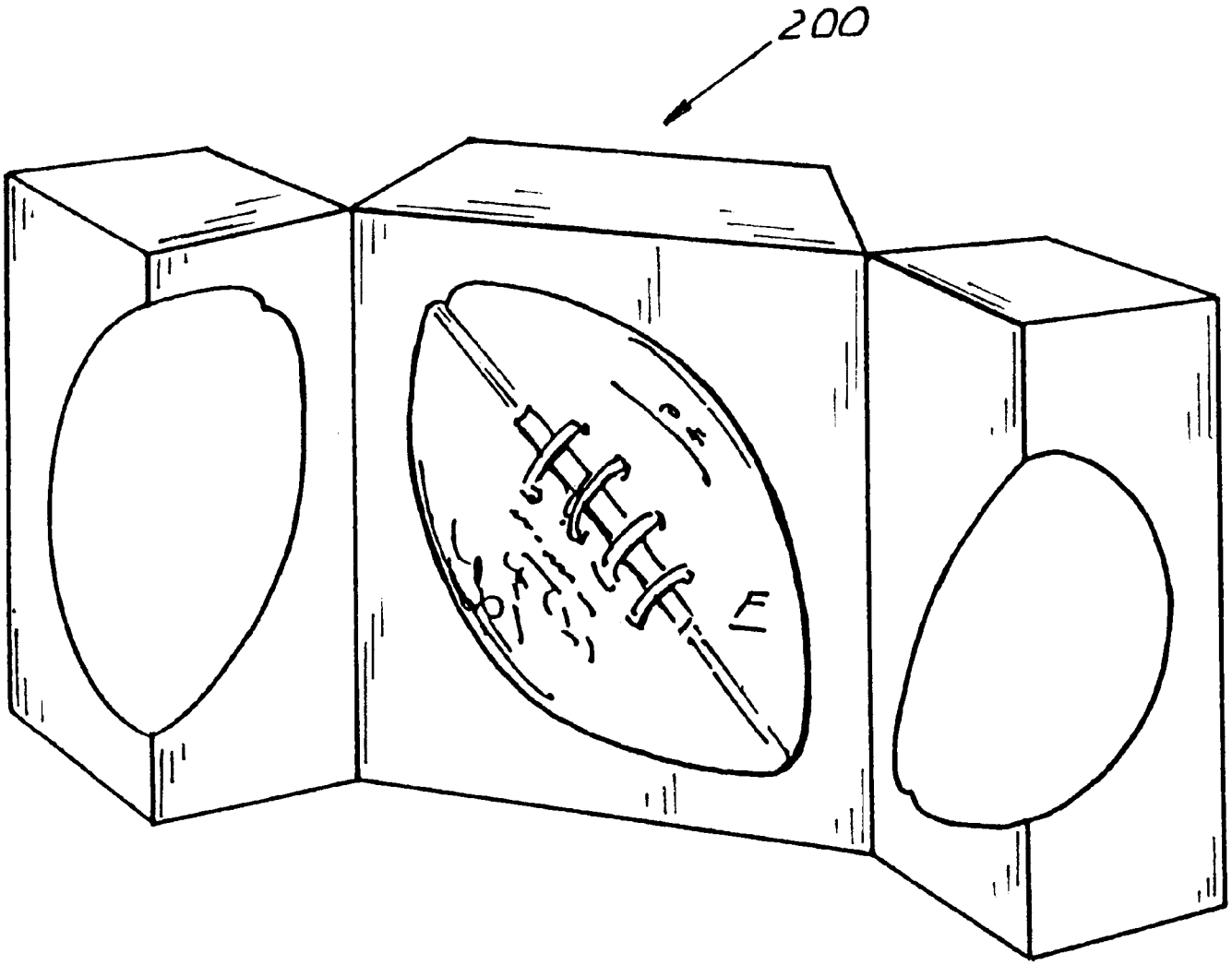
FIG. 17 is a top right front elevational view of the embodiment of FIG. 11, retaining a third object.

Again, all embodiments of the invention are adaptable for protecting various objects during shipment and for retaining and displaying them. For example, FIG. 15 illustrates the package 200 retaining and displaying a can C. FIG. 16 shows the package 200 retaining and displaying a medicine bottle M. FIG. 17 shows the package 200 retaining and displaying a football F.

Figure 19:
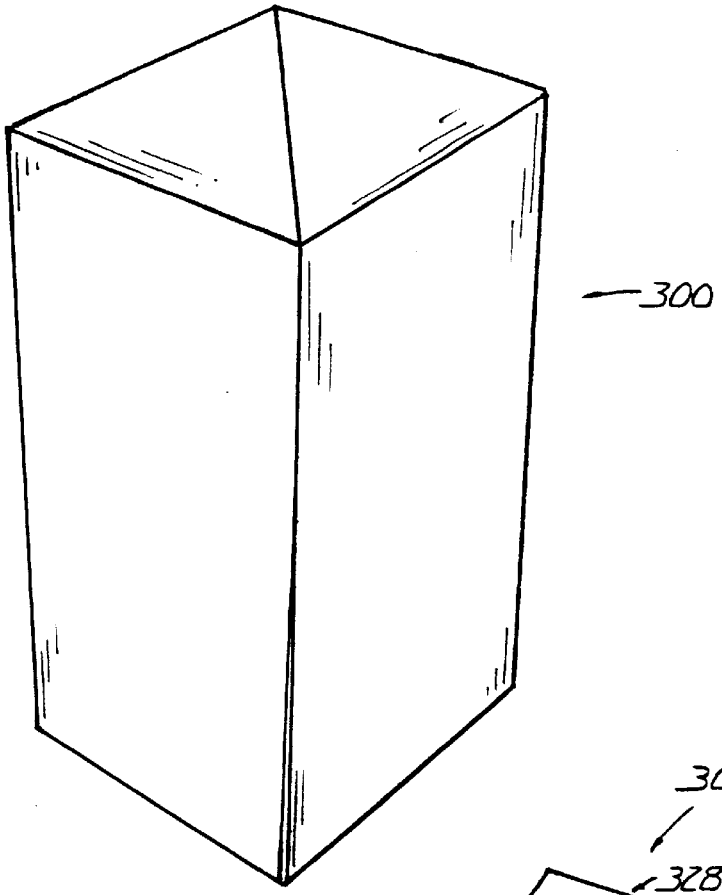
FIG. 19 is a top right front elevational view of the embodiment of FIG. 18, manipulated into a closed position.
Figure 18:
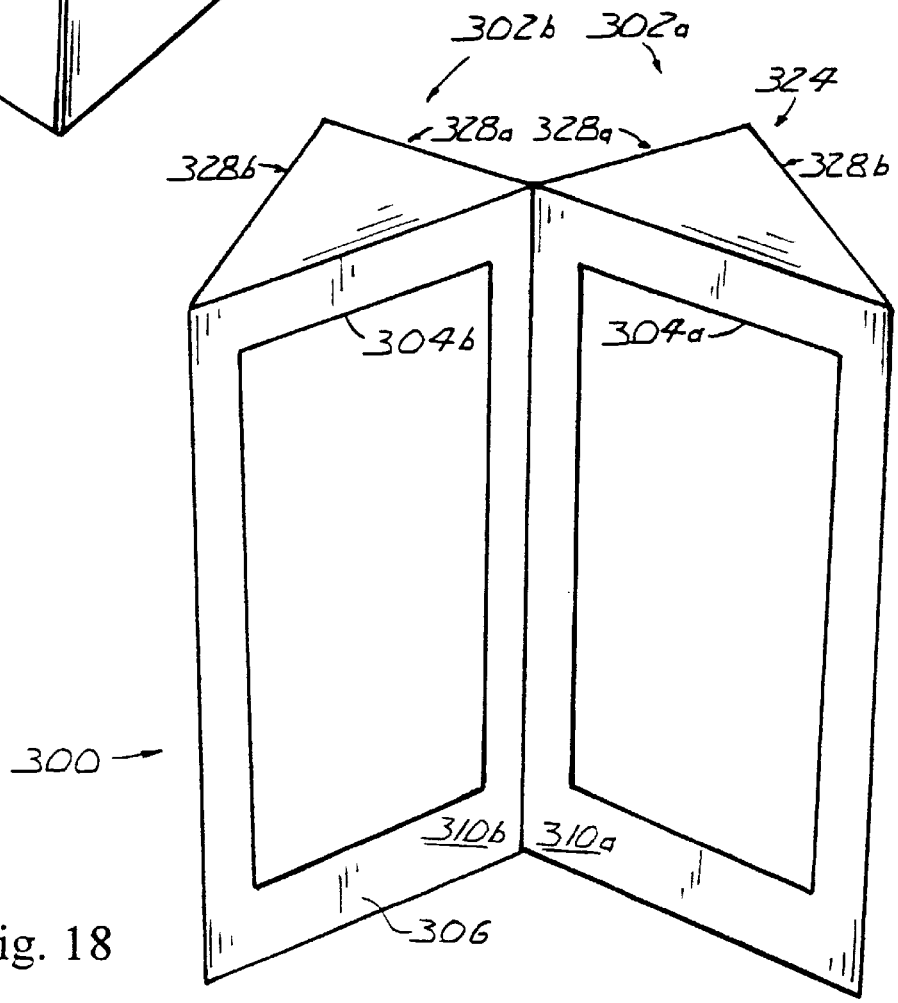
FIG. 18 is a top right front elevational view of a further embodiment of a package, manipulated into an open position, constructed according to principles of the invention.

Referring to FIG. 18, a further embodiment of a package 300 configured according to principles of the invention is shown manipulated into an open position. FIG. 19 shows the package 300 manipulated into a closed position. The package 300 has a main compartment 302*a* with a main aperture 304*a* for retaining an object (not shown). The package 300 has a manipulable adjacent compartment 302*b* with an adjacent aperture 304*b* which accommodates the object (not shown). The adjacent compartment 302*b* may maintain the object (not shown) in the adjacent aperture 304*a* when the package 300 is in the closed position.

Referring also to FIG. 20, the package 300 includes an inner blank 306 that is folded along fold line 308, defining interior panels 310*a* and 310*b*. The main interior panel 310*a* provides the main aperture 304*a* and the adjacent interior panel 310*b* provides the adjacent aperture 304*b*. In this embodiment, as shown on FIG. 18, the main interior panel 310*a* essentially defines a plane, thus the main aperture 304*a* falls essentially within a plane. As with the foregoing embodiments, the invention does not require that the main interior panel 310*a* or main aperture 304*a* remain in a plane, only that the main aperture 304*a* be configured to retain an object. Also, the principles pertaining to retaining an object with the main compartment 302*a* of the package 300 are substantially similar to the principles discussed for the foregoing embodiments.

In this embodiment of a package 300, the adjacent interior panel 310*b* defines a plane, thus the adjacent aperture 304*b* falls in a plane. Although different from the foregoing embodiments, the adjacent interior panel 310*b* and adjacent aperture 304*b* of the package 300 are configured to contact or maintain an inserted object when the package 300 is in the closed position, as shown in FIG. 19, as with the foregoing embodiments. The principles pertaining to maintaining an object with the adjacent compartments 302*b* of the package 300 are substantially similar to the principles discussed for the foregoing embodiment.

Referring to FIGS. 18 and 21, the package 300 includes an exterior blank 324 that is folded along fold lines 326*a* and *b,* defining a plurality of panels 328*a* and *b*. As shown in FIG. 18, a set of exterior panels 328*a–b* combines with main interior panel 310*a* and adjacent interior panel 310*b* to define the main compartment 302*a* and adjacent compartment 302*b,* respectively.

The exterior blank 324 mounts onto the interior blank 306 with glued tabs configured to maintain the interior blank 306 in the intended design positions, as shown in FIGS. 18 and 19. To that end, the exterior panel 328*a* includes flaps 330*a* that fold along fold lines 332*a* toward the viewer until each flap 330*a* defines essentially a right dihedral angle with the main exterior panel 328*a*. The exterior panel 328*a* is folded along fold line 326*b* toward the viewer until the lateral edges 334*a* abut the exterior panel 328*b*. Abutment of the lateral edges 334*a* and exterior panel 328*b* is not critical to the design, but aids in assembly of the package 300. Offsetting the lateral edges 334*a* from the fold line 326*b* also is not critical, but aids in assembly of the package 300.

The exterior panel 328*b* includes flaps 330*b* with tabs 336*b*. Once the exterior panels 328*a* and *b* and flaps 330*a* are positioned, the flaps 330*b* are folded along fold lines 332*b* toward the viewer until each flap 330*b* contacts a flap 330*a* and defines essentially a right dihedral angle with the exterior panel 328*b*. Contact between the flaps 330*a* and *b* is not critical to the invention, but such enhances package integrity. Once the flaps 330*b* are positioned, tabs 336*b* are folded along fold lines 338*b* toward each other and positioned to mate with interior panels 310*a* or *b,* as shown in FIG. 18.

Figure 22:
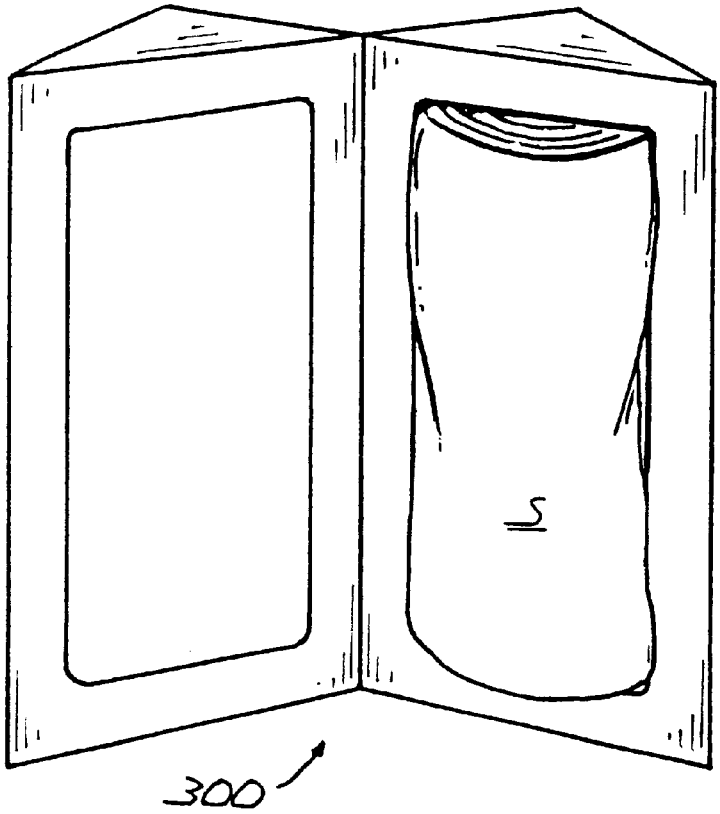
FIG. 22 is a top right front elevational view of the embodiment of FIG. 18, retaining a first object.
Figure 23:
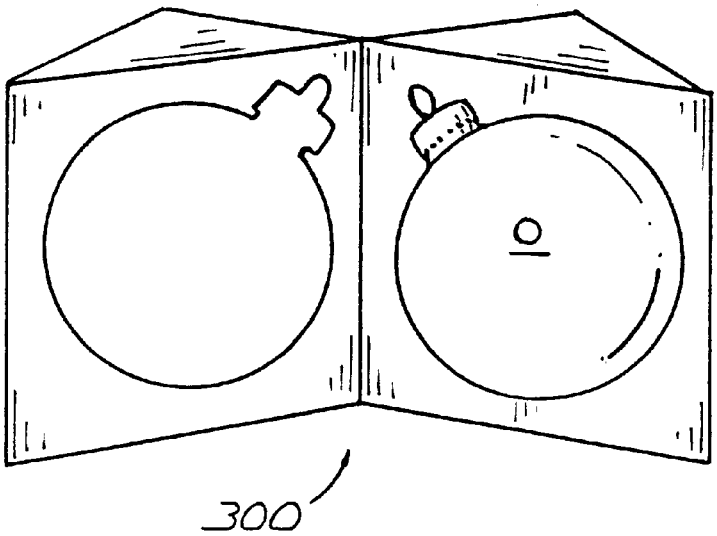
FIG. 23 is a top right front elevational view of the embodiment of FIG. 18, retaining a second object.

Once again, all embodiments of the invention are adaptable for protecting various objects during shipment and for retaining and displaying them. For example, FIG. 22 illustrates the package 300 retaining and displaying a rolled article of clothing S, such as a T-shirt. FIG. 23 shows the package 300 retaining and displaying an ornament O.

Figure 24:
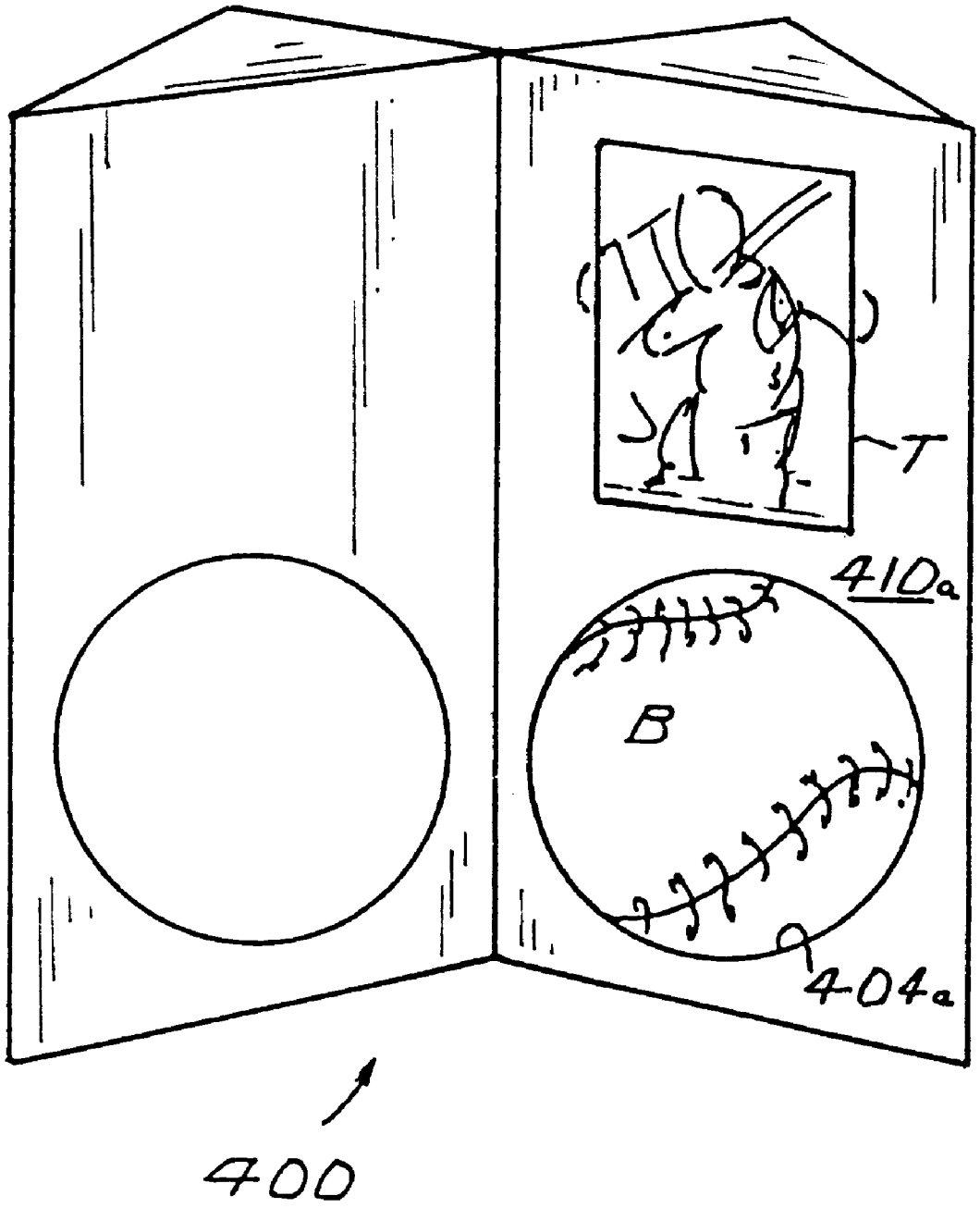
FIG. 24 is a top right front elevational view of an additional embodiment of a package, manipulated into an open position, constructed according to principles of the invention, retaining a first and a second object.

FIG. 24 shows an additional embodiment of a package 400 configured according to principles of the invention, shown manipulated into an open position, retaining and displaying a baseball B along with a baseball trading card T. This embodiment takes advantage of a spacious inner panel 410*a* with an offset main aperture 404*a,* which affords space for displaying indicia or mounting other objects.

The foregoing embodiments of the invention provide a main compartment with an aperture for retaining an object and one or two adjacent compartments with adjacent apertures for maintaining the object when the package is in a closed position. The invention is not limited to one or two adjacent compartments, but may employ any number of compartments.

The invention is not limited to the above, but encompasses all improvements and substitutions consistent with the principles of the invention.

I claim:

1. A package having structure configured for concealing an object comprising:

a first section including a first panel, which is substantially planar, having a first aperture entirely therein configured to receive the object; and a second section, hinged to said first section, including a second panel and a third panel, having a non-co-planar orientation, and a second aperture, extending in said second panel and said third panel, configured to receive the object.

2. The package of claim 1, wherein said first aperture is configured to resist passage of the object therethrough.

3. The package of claim 1, wherein said first aperture is configured to provide an interference fit with the object.

4. The package of claim 1, wherein, when said panel retains an object and said package is manipulated into said closed position, one or more of said one or more second panels contact(s) the object.

5. The package of claim 4, wherein the object has a surface and, when said second aperture receives the object, said second aperture maintains, but does not retain, the surface of the object.

6. The package of claim 1, wherein the object is selected from a can, a bottle, a ball, a baseball, a football, an article of clothing, an ornament and a card.

7. The package of claim 1, further comprising an object received in said first aperture.

8. The package of claim 7, wherein the object has a first shape and said first aperture has a second shape complementary of the first shape.

9. The package of claim 7, wherein the object has a first shape and said second aperture has a second shape complementary of the first shape.

10. The package of claim 7, wherein said object is selected from a can, a bottle, a ball, a baseball, a football, an article of clothing, an ornament and a card.

11. The package of claim 1, wherein the object has a surface and, when said second aperture receives the object, said second aperture maintains, but does not retain, the surface of the object.

* * * * *